US008989629B2

(12) United States Patent
Kishi et al.

(10) Patent No.: US 8,989,629 B2
(45) Date of Patent: Mar. 24, 2015

(54) CHARGING MEMBER AND IMAGE FORMING APPARATUS

(75) Inventors: Yosuke Kishi, Suntou-gun (JP); Ryosuke Kanai, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/824,057

(22) PCT Filed: Dec. 5, 2011

(86) PCT No.: PCT/JP2011/078633
§ 371 (c)(1),
(2), (4) Date: Mar. 15, 2013

(87) PCT Pub. No.: WO2012/081528
PCT Pub. Date: Jun. 21, 2012

(65) Prior Publication Data

US 2013/0170859 A1 Jul. 4, 2013

(30) Foreign Application Priority Data

Dec. 14, 2010 (JP) ..... 2010-278186

(51) Int. Cl.
*G03G 15/02* (2006.01)

(52) U.S. Cl.
CPC ..... *G03G 15/0233* (2013.01); *G03G 15/025* (2013.01)
USPC ..... 399/174; 361/225

(58) Field of Classification Search
USPC ..... 399/174; 361/220, 221, 223, 225; 430/902
See application file for complete search history.

(56) References Cited

U.S. PATENT DOCUMENTS

| | | | | |
|---|---|---|---|---|
| 5,842,081 | A | 11/1998 | Kaname et al. | |
| 5,873,013 | A * | 2/1999 | Matsushita et al. | 399/174 |
| 5,999,773 | A | 12/1999 | Yasutomi et al. | |
| 7,630,678 | B2 | 12/2009 | Kishi et al. | |
| 7,773,934 | B2 | 8/2010 | Kishi et al. | |
| 2011/0222903 | A1 | 9/2011 | Kishi | |

FOREIGN PATENT DOCUMENTS

| | | |
|---|---|---|
| JP | 2006-208550 | 8/2006 |

* cited by examiner

*Primary Examiner* — Sophia S Chen
(74) *Attorney, Agent, or Firm* — Fitzpatrick, Cella, Harper & Scinto

(57) ABSTRACT

A blade-like charging member comprises a charging portion, a non-charging portion, and an electrode portion. The non-charging portion is capable of contacting the image bearing member while maintaining an electrically dischargeable gap therebetween. To prevent electric discharge between the non-charging portion and the surface of the image bearing member, at least part of the non-charging portion is made of material having a higher resistance than that of the charging portion. The non-charging portion contacts and slides on the surface of the image bearing member over a range that exceeds the length of the charging portion. A shortest distance between the discharge position and an end portion of the electrode portion with respect to a longitudinal direction of the image bearing member is longer than a shortest distance between the discharge position and a central portion of the electrode portion with respect to the longitudinal direction of the image bearing member.

6 Claims, 13 Drawing Sheets

(a)

(b)

CHARGING MEMBER AND IMAGE FORMING APPARATUS

TECHNICAL FIELD

The present invention relates to a blade-like charging member for charging a surface of an image bearing member, wherein the charging member moves relative to an image bearing member (member to be charged) on which an electrostatic latent image is formed while a non-charging portion is in contact with the image bearing member and the charging member is supplied with a DC voltage. The present invention relates also to an image forming apparatus using the charging member.

BACKGROUND ART

Here, a typical example of the image bearing member on which the electrostatic latent image is formed is an electrophotographic photosensitive member or a dielectric member for electrostatic recording. As for the image forming apparatus, examples include an electrophotographic type or electrostatic recording type copying machine, printer, facsimile machine or a complex machine thereof, and an image display device or the like.

The description will be made, as an example, to a transfer type electrophotographic image forming apparatus. Generally, in such an apparatus, the electrostatic latent image of image information is formed by charging means for uniformly charging a surface of the image bearing member (rotatable drum type electrophotographic photosensitive member) to a predetermined polarity and potential and by exposure means for selectively exposing the thus charged drum surface to the light of the image information. The latent image is visualized (developed) into a toner image using a developer (toner) by developing means. The toner image is transferred onto a recording material by transferring means. The toner image on the recording material is fixed by a fixing means into a fixed image. The recording material is outputted as a print.

A recently dominant charging means (charging device) is a contact-charging type means using a fixed type charging member such as a blade or film, or a rotating type charging member such as a brush, roller, belt of semiconductive rubber or resin material.

The contact-charging type does not necessitate an ozone removing filter because the amount of produced ozone is small. An applied voltage required to charge the drum surface up to a predetermined potential can be reduced. It is, therefore, advantageous in the downsizing and the low cost.

A charging mechanism of the contact-charging type will be described. It is known that the charging mechanism for the drum surface in the contact charging system is ruled by Paschen's Law relating to the electric discharge in a small gap.

1) In the case of charging roller:

Referring to FIG. 14, parts (a) and (b) are a schematic perspective view and a schematic sectional view of a charging roller using a rotating type charging roller 21 as the charging member. The charging roller 21 comprises an electroconductive core metal and the electroconductive elastic layer 21*b* formed on the core metal 21*a* concentrically therewith. The drum 1 comprises an electroconductive drum base member (bare tube) 12 and a photosensitive layer 11 on the outer surface of the drum base member 12. The charging roller 21 is substantially parallel with the drum 1 and is contacted at a predetermined urging force.

The charging roller 21 has a length to cover an image forming region (maximum image region width) G of the surface of the drum 1 and is rotated by the rotation of the drum 1. To the core metal 21*a* of the charging roller 21, a predetermined charging bias voltage is applied from the charging bias voltage applying source V so that a bias voltage is applied to the elastic layer 21*b* through the core metal 21*a*. By this, the surface of the rotating drum 1 is charged uniformly to the predetermined polarity and potential.

Part (c) of FIG. 14 shows an electrical equivalent circuit of the drum 1 and the air layer of the fine gap concerned with the discharge between the charging roller 21 and the drum 1. An impedance of the charging roller 21 is small as compared with that of the drum 1 and that of the air layer, and therefore, it is neglected here. Then, a charging mechanism can be simply expressed by two capacitors C1 and C2. When a DC voltage is applied to the equivalent circuit, it is divided proportionally to the impedances of the capacitors, and therefore, the voltage Vair across the air layer is, $$Vair=C2/(C1+C2) \quad (1)$$

The air layer has a dielectric breakdown voltage determined by Paschen's Law, and it is as follows when the thickness of the air layer is g [micron]:

$$312+6.2\ g[V] \quad (2)$$

When Vair exceeds this, the discharge occurs.

The minimum discharging voltage is that when formula (1) is equal to formula (2) and the air layer thickness g obtained by the equation has a double root (C1 is also a function of g), and a DC voltage value at this time is a discharge starting voltage Vth. The theoretical value Vth thus obtained is very close to an experiment value.

The charging roller tends to be complicated in the structure since it requires a rotatable supporting member 211, an urging spring 212 and so on for the charging roller 21. A brush charging member (charging brush) is time-consuming in manufacturing the brush, irrespective of whether it is rotating type or fixing type, and tracks of the brush fibers may result in unevenness of charging.

2) In the case of charging blade:

FIG. 15 is a schematic perspective view of a charging blade using a fixed type charging blade 22 as the charging member. The charging blade comprises an electroconductive elastic blade portion 220 as a charging blade 22 and an electroconductive supporting member 223 supporting the blade portion 220. The blade portion 220 has a length enough to cover the entire width of the image forming region of the surface of the drum 1. The charging blade 22 is set substantially parallel with the drum 1, the blade portion 220 is contacted to the drum 1, and the supporting member 223 is fixed to a stationary member.

A predetermined charging bias voltage is applied from a charging bias voltage applying source V to the supporting member 223, so that the bias voltage is applied to the blade portion 220 through the supporting member 223. By this, the surface of the rotating drum 1 is charged uniformly to the predetermined polarity and potential. The discharge occurs in the wedged small gap formed between the blade portion 220 and the drum 1, and a relatively stable small gap can be formed. The rotation supporting member 211 and the urging spring 212 and so on required by the charging roller are unnecessary, and therefore, the blade type is inexpensive.

A scraping amount of the drum 1 in the case of the contact charging type is larger in the charging region than outside thereof, that is, the surface of the drum 1 tends to be scraped. In addition, the scraping of the surface of the drum 1 at an end of the charging region is particularly remarkable. The reasons why the drum 1 scraping is large in the end of the charging region are as follows.

1) at a longitudinal end of the charging member, concentrated discharge occurs from an edge, and therefore, the discharge at the end is more intense than in the longitudinal central portion.

2) as a result of the flexure caused by the contact between the drum and the charging member, the contact pressures therebetween are larger at the opposite longitudinal ends than in the central portion.

For these reasons, the scraping of the drum 1 is remarkable at the longitudinal end positions of the charging member. Because of the recent demand for the downsizing of the device, the longitudinal dimensions of the drum and the charging roller are very close to the width of the image forming region (maximum image forming region width) G, which results in an image defect caused by remarkable scraping of the drum surface at the longitudinal end position of the charging member. Taking into account the fact that the area of the drum surface contacting the cleaning blade also tends to be scraped, it has been proposed that the end positions of the charging roller be located outside the contact area of the cleaning blade (Japanese Laid-open Patent Application 2006-208550).

DISCLOSURE OF THE INVENTION

However, with the contact charging type in which the blade configuration charging member (charging blade or blade) is used, the fixed charging blade contacts the drum. In other words, because of the sliding between the charging blade and the drum during drum rotation, the scraping at the end of the charging region is larger than in the case of a charging roller in which the charging roller is rotated by the drum.

The present invention is directed to the problem with the blade-like charging member. It is an object of the present invention to provide a charging member in which the remarkable scraping of the image bearing member at the end portions of the charging member is suppressed. It is another object of the present invention to provide an image forming apparatus using such a charging member.

According to an aspect of the present invention, there is provided a blade-like charging member for charging a surface of an image bearing member by contacting thereto and by being supplied with a voltage. The charging member comprises a charging portion for effecting electric discharge to the surface of the image bearing member, and a non-charging portion not effecting the electric discharge to the surface of the image bearing member. The non-charging portion is capable of contacting said image bearing member while maintaining an electrically dischargeable gap between said charging portion and said image bearing member, wherein at least a part of said non-charging portion is made of a material having a higher resistance than that of said charging portion so as to prevent electric discharge between said non-charging portion and the surface of said image bearing member. Further, the non-charging portion is contacted to and slidable on the surface of said image bearing member over a range not less than a longitudinal dimension of said charge portion, such that when the surface of said image bearing member is charged, a closest distance between a discharging position of a surface of said charge portion and an electrode portion for applying a voltage to said charging member is longer in a longitudinal end portion of said charging member than in a longitudinally central portion.

According to the present invention, the discharge concentration on the end portions of the charging member is reduced, and the contact pressures at the end portions are reduced, so that the remarkable scraping of the image bearing member in the end position of the charging member is reduced, and the lifetime of the image bearing member can be extended.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

The preferred embodiments of the present invention will be described in conjunction with the accompanying drawings. Here, the dimensions, the sizes, the materials, the configurations, the relative positional relationships of the elements in the following embodiments and examples are not restrictive to the present invention unless otherwise stated.

Embodiment 1

Figure 2:
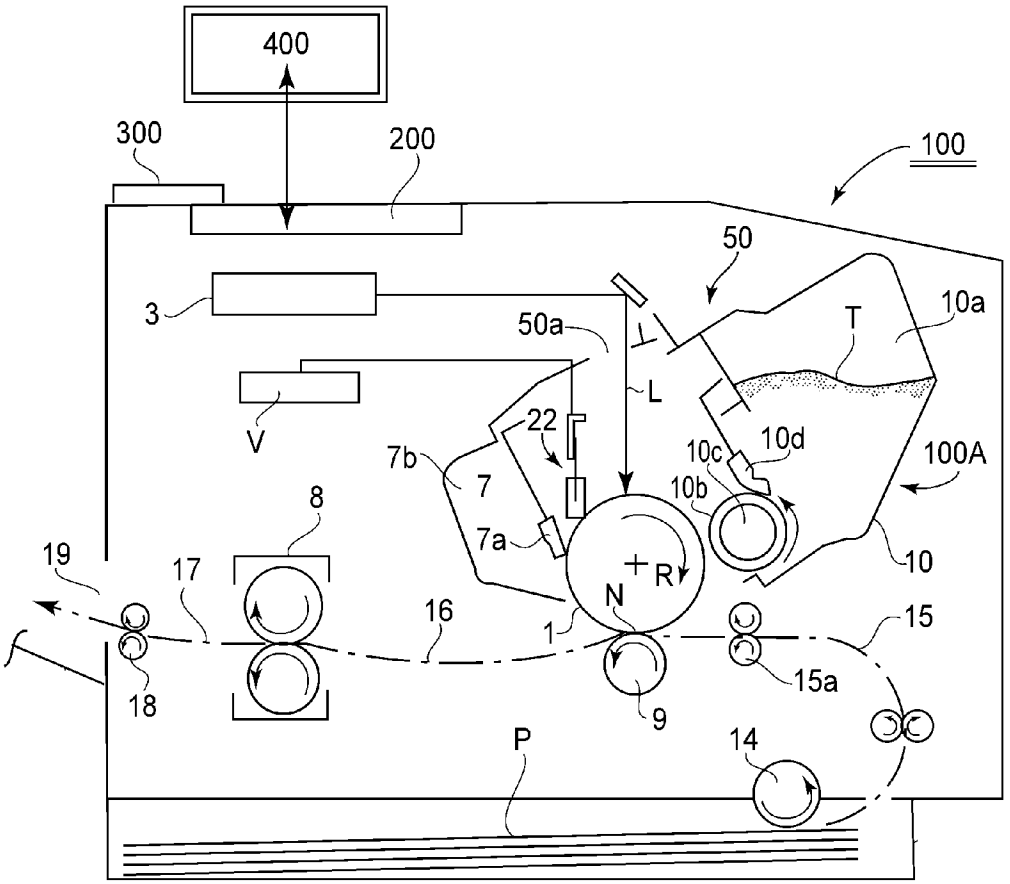
FIG. 2 is a schematic view of an example of an image forming apparatus using the charging blade of Embodiment 1.

(1) General Structure of an Example of an Image Forming Apparatus and an Image Forming Operation Thereof FIG. 2 is a schematic illustration of an example of an image forming apparatus 100. The device 100 is an electrophotographic image forming apparatus of a process cartridge mounting and demounting type using an electrophotographic process. The device 100 forms an image on a recording material (recording material) P on the basis of an electrical image signal inputted to a control circuit portion (control means, CPU) 200 from a host apparatus 400 such as a personal computer, an image reader or a facsimile machine.

The recording material P is a sheet on which an image can be formed by an electrophotographic process, and is a sheet of paper, a resin material sheet, a label or the like. The control circuit portion 200 exchanges various electrical information with an operating portion 300 or the host apparatus 400, and controls overall image forming operation of the device 100 in accordance with predetermined control program and reference table stored in a storing portion.

In a main assembly of the apparatus of the device 100, there is provided a cartridge accommodating portion 100A. A process cartridge 50 is demountably mounted to the cartridge accommodating portion 100A through a predetermined operation manner. In this embodiment, the cartridge 50 is an integral type process cartridge. More particularly, an electrophotographic photosensitive drum has an image bearing member on which an electrostatic latent image developed with a developer T is formed, and charging means actable on the drum 1 are mounted to a common casing into a unit. In this embodiment, the process means includes charging means 22, developing means 10 and cleaning means 7.

In this embodiment, the drum 1 is an organic photosensitive member having a negative charging property. The charging means 22 is a charging blade (blade-like charging member). The charging blade 22 will be described hereinafter. The developing means 10 is a jumping and reverse type developing device operable with one component magnetic toner as the developer T. In the following, the developer T will be called toner, too. The cleaning means 7 is a blade cleaning device using an elastic cleaning blade 7*a* as the cleaning member.

The developing device 10 includes a developing container 10*a* as a developer accommodating portion accommodating the toner T. It also includes a developing sleeve 10*b* as a developer carrying member for developing an electrostatic latent image formed on the drum 1 into a toner image, a non-rotatable magnet roller 10*c* provided in the sleeve 10*b*, a developing blade 10*d* for regulating an amount of the toner on the developing sleeve 10*b*, and so on.

Above the cartridge accommodating portion 100A, there is provided a semiconductor laser scanner 3 as image exposure means. The scanner 3 outputs a laser beam L modulated in accordance with the image information inputted to the control circuit portion 200 from the host apparatus 400. The laser beam L enters the cartridge 50 through an exposure window provided in a top side. By doing so, the surface of the drum 1 is scanningly exposed to a laser beam.

To the drum 1 in the cartridge 50, a transfer roller 9 is contacted to form a transfer nip N. The cartridge 50 accommodated in the cartridge accommodating portion 100A is urged to a positioning portion (unshown) in the main assembly side of the apparatus by an urging means (unshown), so that the cartridge 50 is correctly positioned. In addition, a drive outputting portion (unshown) of the main assembly side of the apparatus is connected to a drive inputting portion (unshown) of the cartridge 50. To various electrical contacts (unshown) of the cartridge 50, the corresponding electrical contacts (unshown) of the main assembly side of the apparatus are contacted. The drum 1 is controlled by a driving source (unshown) controlled by the control circuit portion 200.

The image forming operation is as follows. The drum 1 is rotated in the clockwise direction indicated by arrow R at a predetermined peripheral speed. The scanner 3 is driven, too. In synchronism with the drive, a predetermined charging bias voltage is applied from a charging bias voltage applying source V to the charging blade 22 at predetermined control timing so that the surface of the drum 1 is charged uniformly to the negative polarity in this embodiment and potential by the charging blade 22 by a non-contact type charging. The scanner 3 scans and exposes the surface of the drum 1 by a laser beam L modulated in accordance with the image signal. On the surface of the drum 1, an absolute value of the potential of the exposed portion becomes lower than the absolute value of the charged potential, so that the electrostatic latent image is sequentially formed in accordance with the image information.

The electrostatic latent image thus formed is developed into a toner image by the toner carried on the developing roller 10*b* of the developing device 10. The developing roller 10*b* is rotated in a counterclockwise direction indicated by an arrow at a predetermined speed. To the developing roller 10*b*, a predetermined developing bias voltage is applied at predetermined control timing from a developing bias applying voltage source portion (unshown). To the developing roller 10*b*, a predetermined developing bias voltage comprising AC and DC components is applied at predetermined control timing. In the contact position between the developing blade 10*d* and the developing roller 10*b*, the toner charged to the negative by triboelectric charge is applied to the electrostatic latent image on the surface of the drum 1 to effect reverse development of the electrostatic latent image.

On the other hand, one recording material P is separated and fed out of a sheet feeding mechanism portion (unshown) by a sheet feeding roller 14. The recording material P is introduced into the transfer nip N at the predetermined control timing through a sheet path 15 including registration rollers 15*a* and is nipped and fed through the nip N. As the recording material P moves through the nip N, a predetermined transfer bias is applied to the transfer roller 9 from a transfer bias application voltage source portion (unshown). By this, the toner image is transferred from the drum 1 onto the surface of the recording material P sequentially.

The recording material P having passed through the nip N is separated from the surface of the drum 1 and is introduced into the fixing device 8 through a sheet path 16. In this embodiment, the fixing device 8 is a heat roller fixing device, and the recording material P is nipped and fed by a fixing nip and is subjected to heat and pressure. By this, the unfixed toner image on the recording material P is heat-pressure fixed into a fixed image. The recording material P discharged from the fixing device 8 is discharged from the device 100 as a print by discharging rollers 18 through a sheet path 17 through a discharge opening 19.

The untransferred toner remaining on the drum 1 without being transferred onto the recording material P in the transfer nip N is scraped by a cleaning blade 7*a* comprising urethane rubber of a cleaning device 7, and is accommodated in a residual toner container 7*b*. The cleaned drum 1 is used repeatedly for image formation. The cleaning blade 7*a* is contacted to the drum 1 along a longitudinal direction thereof at a predetermined pressure. The surface of the drum 1 is cleaned by removing the untransferred toner. After the cleaning process, the surface of the drum 1 reenters the charging step.

(2) Charging Blade

Figure 3:
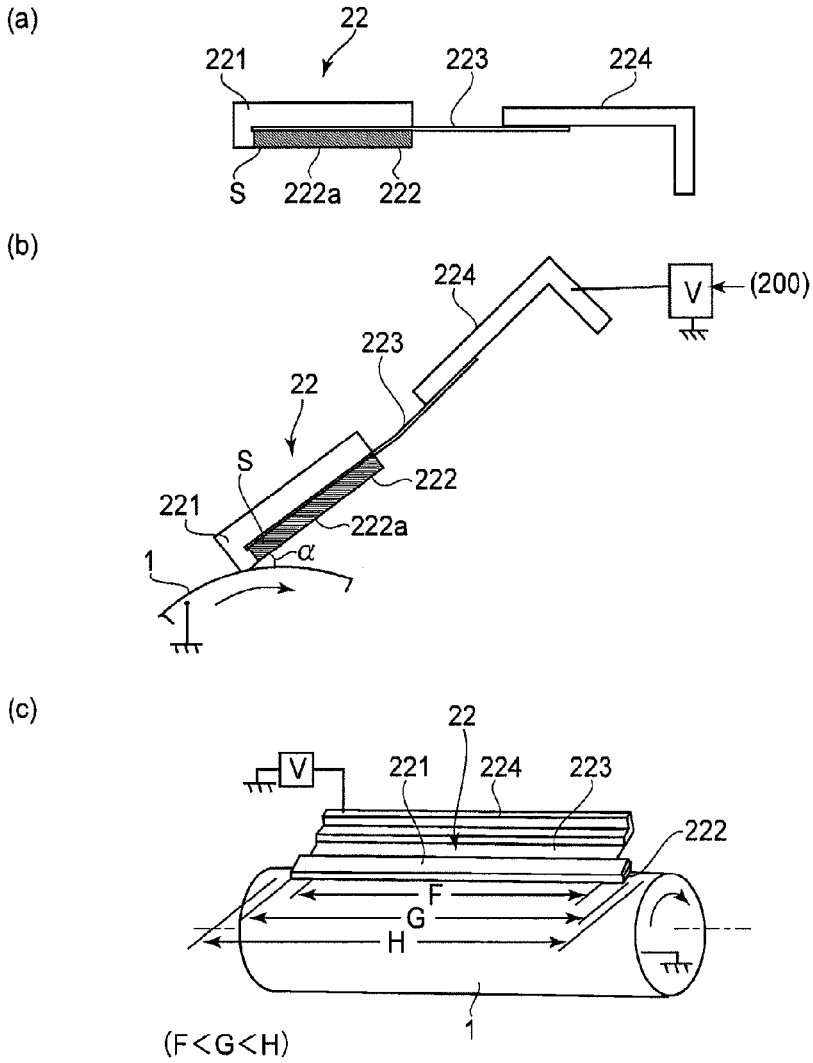
In FIG. 3, (a) is a side view of the charging blade of the Embodiment 1, (b) is a side view of the charging blade provided relative to the drum, and (c) is an inclined observing schematic view of the charging blade provided relative to the drum.

In FIG. 3, (a) is a side view of the charging blade 22 of the embodiment, (b) is a side view of the charging blade 22 in the state that it is provided relative to the drum 1, and (c) is an inclined observing schematic view the charging blade 22 in the state that it is provided relative to the drum 1.

The charging blade 22 comprises a electroconductive charging portion 222 for effecting discharge to the surface of drum 1, and a non-charging portion (insulating portion) 221 which does not effect the discharge to the surface of drum 1. The non-charging portion 221 contacts the drum 1 to provide a gap between the charging portion 222 and the drum 1, across which the electric discharge occurs. At least a part of the non-charging portion 221 is made of a high resistance material having a resistance higher than that of the charging portion 222 to prevent discharge between the non-charging portion 221 and the surface of the drum 1. The non-charging portion 221 is contacted to the surface of the drum 1 over the total width (width F) of the image forming region and slides on the surface of the drum 1.

The detailed description will be made. The charging blade 22 includes an electrode portion 223 functioning also as a supporting portion supporting the non-charging portion 221 and the charge portion 222. In this embodiment, the electrode portion 223 is made of a phosphor bronze plate (elastic electroconductive plate member) having a thickness of 0.1 mm. The electrode portion 223 is elongated in the generatrix direction (drum axis direction) of the drum 1, and has a dimension corresponding to the total width (width F) of the image forming region of the drum 1.

Figure 10:
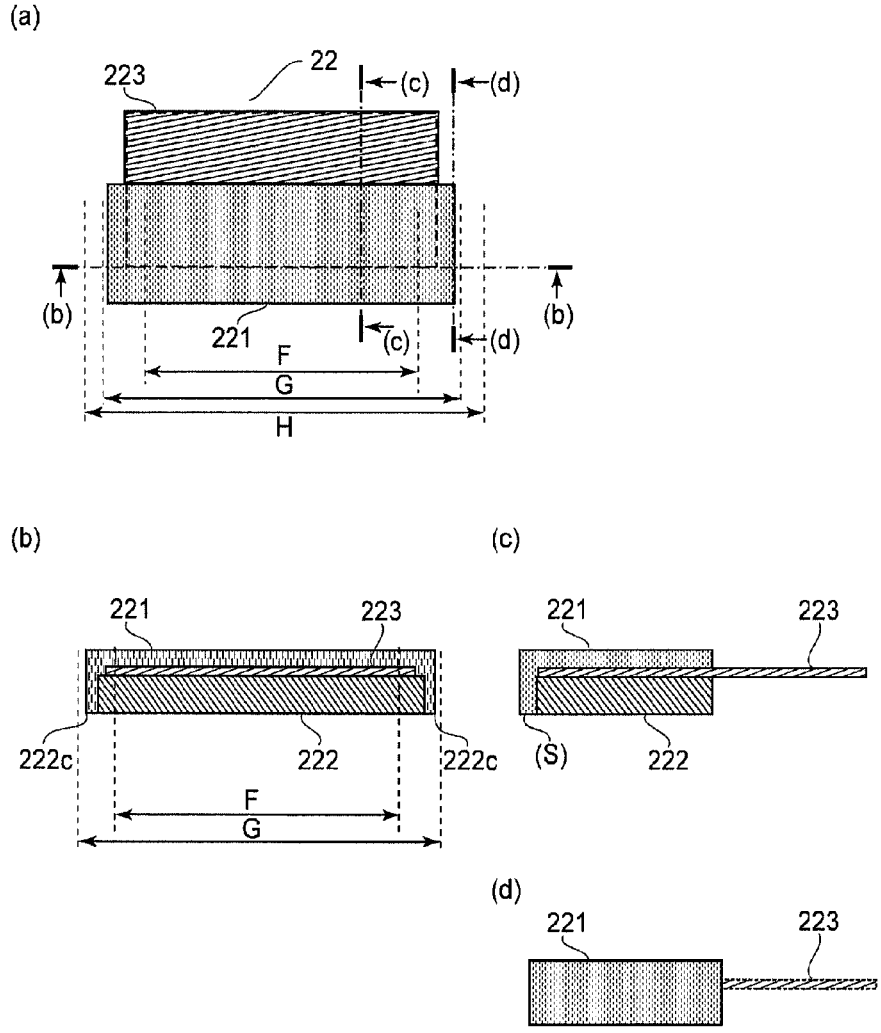
FIG. 10 is an illustration of further example of Embodiment 1.

A free end side of the electrode portion 223 (one end of the electrode portion 223 with respect to the widthwise direction) is coated with a non-charging portion 221 along the length of the electrode portion 223. In this embodiment, the non-charging portion 221 constitutes a free end portion of the charging blade 22, and is long enough to cover substantially the entire width of the maximum sheet processing width G (>F) of the drum 1. As shown in FIG. 10, the non-charging portion 221 may be contacted to and slides on the surface of the drum 1 over more than the longitudinal width of the charge portion.

In this embodiment, the non-charging portion 221 is made of urethane rubber having a JIS-A hardness of 72°. Alternatively, an insulative rubber such as silicone rubber may be used, if it has a volume resistivity of not less than $1\times10^{11}$ Ωcm.

To the surface of the electrode portion 223 which is faced to the drum 1, a semiconductive charge portion 222 is bonded by an electroconductive adhesive material along the length of the electrode portion 223 to charge the surface of the drum using the electric discharge. Therefore, the charge portion 222 is electrically conductive relative to the electrode portion 223. Also, the charge portion 222 extends substantially over the entire width of the maximum sheet processing width G (more than charge portion) of the drum 1.

The charge portion 222 comprises rubber such as epichlorohydrin rubber, EPDM in which electroconductive powder such as carbon black or metal oxide (zinc oxide, oxide titanium or the like) so as to provide a resistance value of $1\times10^{3}$-$1\times10^{9}$ Ωcm.

If the resistance of the charging portion 222 is smaller than $1\times10^{3}$ Ωcm, the current leakage may occur when the drum 1 has a defect such as a pin hole, with the result of image defect white strips or black stripes. If, on the contrary, it is not less than $1\times10^{9}$ Ωcm, the attenuation of applied voltage is so large that the charging property is poor. Therefore, the resistance value of the charging portion 222 is desirably $1\times10^{3}$-$1\times10^{9}$ Ωcm.

A base portion side (other end of the electrode portion 223 with respect to the widthwise direction) of the electrode portion 223 is connected with a rigid metal plate 224 as a holder by electroconductive adhesive material. Therefore, the charge portion 222 is electrically conducted with the holder 224 through the electrode portion 223. In this embodiment the charging blade 22 is provided counterdirectionally with respect to a rotational moving direction R of the drum 1 during the image forming operation. An edge portion of the non-charging portion 221 at the free end portion of the electrode portion 223 is contacted to the drum 1, the holder 224 is fixed to the casing (unshown) of the cartridge 50, and the edge portion is contacted to the drum 1 at a predetermined urging force by an elastic reaction force of the metal elastic member 223.

In this contact state, a charging surface 222*a* of the charging portion 222 is out of contact with the drum 1. And, the discharging position S of the charging surface 222*a* is out of contact with a dischargeable gap α from the drum 1. In this embodiment, the voltage for the charging blade 22 is applied to the electroconductive holder 224 from a bias applying voltage source which is a voltage applying means. It may be applied to the electrode portion 223. The voltage source V is controlled by the control circuit portion 200 which is the control means.

A bias voltage applied to the holder 224 is applied to the charge portion 222 through the electrode portion 223. By this, the discharge occurs across the small gap between the surface 222*a* of the charge portion 222 and the drum 1 to charge uniformly the surface of drum 1 to a predetermined polarity and potential.

The electrode portion 223 may be made of SUS thin plate or the like. The holder 224 may be mounted to the main assembly of the image forming apparatus, or the electrode portion 223 may be fixed directly to the casing of the process cartridge 50 or directly to the main assembly of the image forming apparatus.

Figure 4:
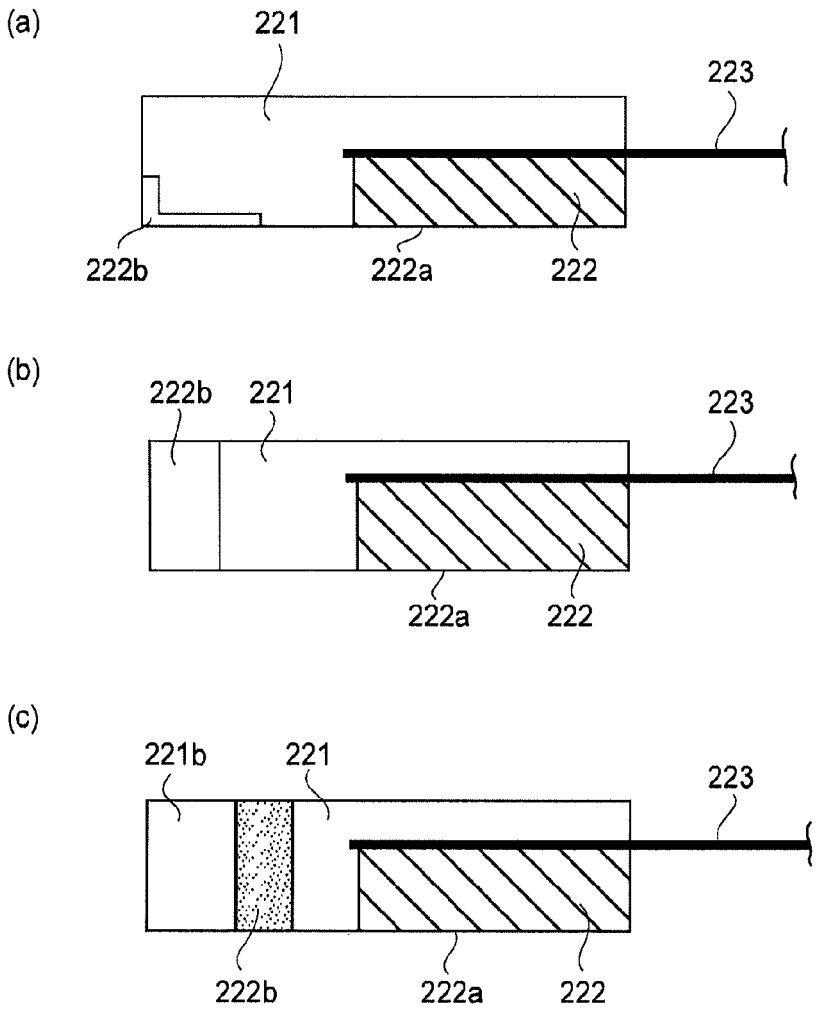
In FIG. 4, (a)-(c) are schematic illustrations of other structures of the charging blade of Embodiment 1.

The free end portion of the charging blade 22 is not necessarily insulative if there is no discharge from the free end portion. For example, as shown in (a) and (b) of FIG. 4, the free end portion of the electrode portion 223 is made of insulative urethane rubber (insulative member) 221, and the free end is made of electroconductive rubber (electroconductive member) 222*b* insulated from the electrode portion 223. The electroconductive rubber 222*b* may be the contact portion contacted to the drum 1.

In addition, in the example of (c), the free end portion of the electrode portion 223 is made of insulative urethane rubber (insulative member) 221. The free end is made of electroconductive rubber (electroconductive member) 222*b* insulated from the electrode portion 223, and the tip end portion is made of insulative urethane rubber (insulative member) 221*b*. The insulative urethane rubber 221*b* may be the contact portion contacted to the drum 1.

Figure 5:
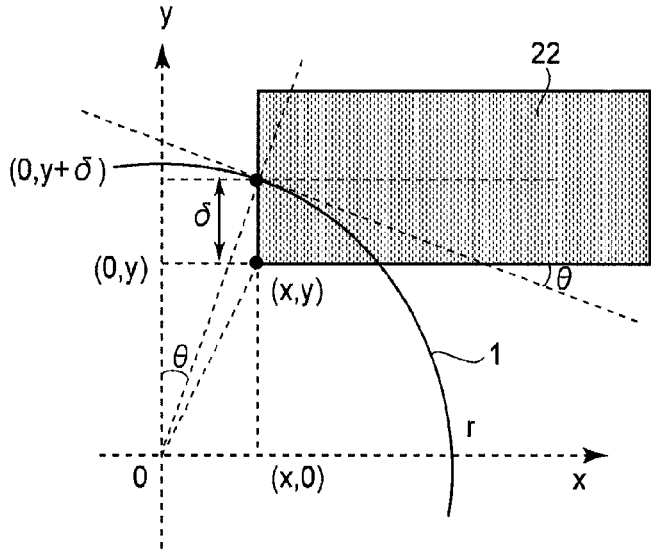
FIG. 5 illustrates and explains a virtual bite δ and set angle θ of the charging blade relative to the member to be charged
Figure 5:
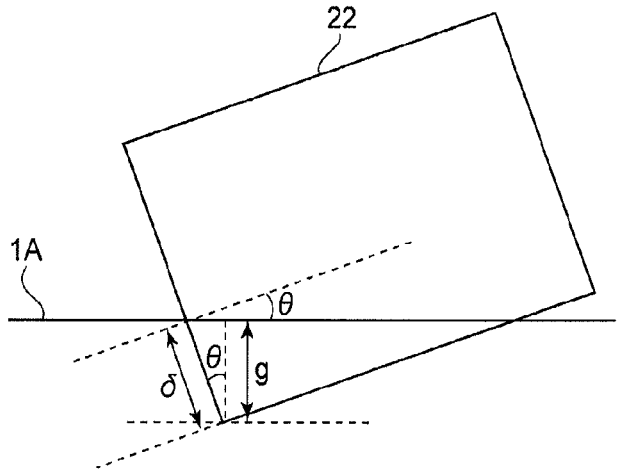

As shown in part (a) of FIG. 5, the charging blade 22 is contacted to the drum 1 counterdirectionally with respect to the rotation of the drum 1 at a set angle θ. As shown in FIG. 3, the blade 22 enters the drum 1 if the drum 1 is phantom, and the entering distance δ is called virtual bite; actually, the charging blade 22 deforms by this distance by the press-contact between the charging blade 22 and the drum 1 so that the behavior of the charging blade is stabilized. Referring to part (a) of FIG. 5, there is shown determination of the actual set angle θ and the virtual bite δ. The set angle θ and the virtual bite δ are measured in a state in which the drum 1 is removed from the combination of the charging blade 22 and the drum 1 during the image formation.

In part (a) of FIG. 5, the drum 1 during the image formation is indicated as a phantom drum 1. X axis passes through the center of the phantom drum and is parallel with such a surface of the charging blade 22 as is opposed to the drum 1. Y axis is perpendicular to the X shaft and passes through the center of the phantom drum 1. As shown in FIG. 5(*a*), coordinate (X, Y) of the free end of the charging blade 22 is determined.

From the coordinate and the radius r of the phantom drum 1 the virtual bite δ and the setting angle θ can be obtained by equation (1) and equation (2).

$$\delta=\sqrt{(r^2-x^2)}-y \quad (1)$$

$$\theta=\arcsin(x/r) \quad (2)$$

Referring to part (a) of FIG. 5, the description has been made as to the actual measurement of the virtual bite δ of the blade into the photosensitive drum 1 having a curvature and the set angle θ. Referring to part (b) of FIG. 5, the description will be made as to the case of flat surface as with a photosensitive belt to which the charging blade is contacted. As is different from the case of (a) of FIG. 5, the set angle θ does not change even if the contact position of the charging blade changes. Therefore, the set angle θ which is an angle relative to the phantom belt flat surface 1A can be easily determined by measuring a mounting angle of the blade 22 relative to a phantom belt flat surface 1A. The virtual bite δ can be determined from the set angle and a distance from the phantom belt flat surface 1A to a blade edge.

$$\delta=g/\cos\theta \quad (3)$$

Figure 6:
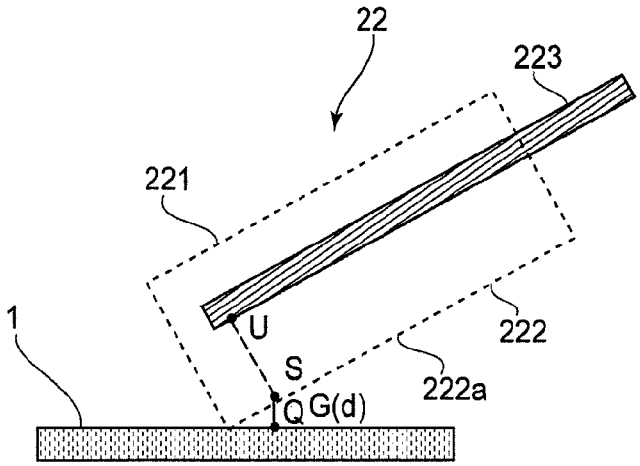
FIG. 6 is an illustration of a contact state between the charging blade and the drum.

FIG. 6 is a schematic view showing a state of the contact portion between the free end portion of the charging blade 22 and the drum 1. The closest point on the charge portion 222 between the drum 1 and the charge portion 222 is S, the closest point on the drum is Q, and the closest position on the electrode portion 223 relative to the position S. If the length g (small gap α) of the line segment QS is less than 7.5 μm, no electric discharge occurs as understood from Paschen's Law. On the other hand, if the length g is not less than 150 μm, the discharge occurs, but the discharge is not uniform, and therefore, a defective image having spots results.

The lower limit value of the small gap g for generating the discharge is constant irrespective of the applied voltage or the discharging member. The lower limit value of the small gap g for the generation of the discharge changes to a certain extent by the ambient pressure. In this embodiment, the above-mentioned 7.5 μm is based on 760 torr. This ambient pressure is an ordinary condition.

Therefore, when the line segment QS is not less than 7.5 μm, the position S on the charge portion 222 at the closest point between the drum 1 and the charge portion 222 is the discharging position. However, when the length of the line segment QS is less than 7.5 μm, the discharging position is downstream of the line segment QS with respect to the rotational moving direction of the drum, where the length is 7.5 μm. In this embodiment, the length g of the line segment QS is not less than 7.5 μm and not more than 150 μm. In this embodiment, therefore, the distance between the drum 1 and the charging portion 222 is not less than 7.5 μm and not more than 150 μm, and the position on the charging portion 222 at the closest position between the drum 1 and the charging portion 222 is the discharging position S.

Verification has been made as to whether or not the theoretical discharging position 220 and the actual discharging position are the same. In the state that the charging blade 22 is press-contacted to the drum 1 which is not rotating, a predetermined charging potential is applied for a predetermined duration. A position of a trace of discharging on the charging portion 222 (discharging trace) is deemed as the actual discharging position. The applied charging potential is enough if the discharge continues, and by applying a sine wave AC voltage having a peak-to-peak voltage 2.0 kV, for example, for 10 minutes, a discharging trace is produced on the charging portion 222.

The result exhibited the position of the discharging trace and the theoretical discharging position are substantially the same. From the foregoing, the above-described theoretical determination of the discharging position is correct.

(3) Verification Experiment

In this Embodiment 1, a distance S-U between the discharging position S of the surface of the charge portion 222 and the electrode portion 223 for applying the voltage to the charging blade 22 where they are closest when the surface of the drum 1 is charged is as follows. The distance S-U at the longitudinal end of the charging blade 22 is longer than the distance S-U in the longitudinally central portion of the charging blade 22.

Figure 1:
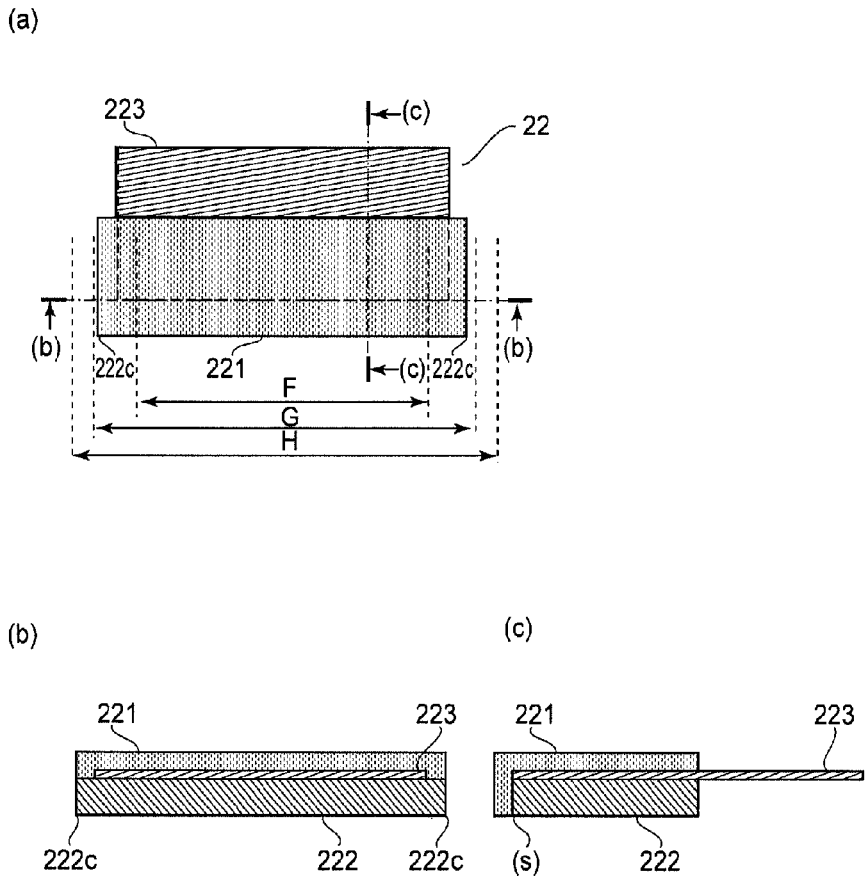
FIG. 1 is a schematic view of a charging blade in Embodiment 1.

FIG. 1 shows the charging blade 22 used in the verification experiment of this Embodiment 1. Part (a) of FIG. 1 is a schematic view as seen from a non-contact side relative to the drum 1, and broken lines depict the outer edges of the electrode portion (supporting portion) 223. Part (b) of FIG. 1 is a sectional view as seen from a position (b) in the direction indicated by the arrow, and part (c) is a sectional view as seen from the position (c) in the direction indicated by the arrow.

As will be understood from FIGS. 1(*a*)-(*c*), a longitudinal dimension of the electrode portion 223 of the charging blade 22 of this Embodiment 1 is shorter than the longitudinal dimension of the charge portion 222. At this time, the image forming region width (maximum image formation width) F of the drum 1, the maximum sheet processing width G and the cleaning width H satisfy F<G<H. The closest distance S-U between the discharging position S and the electrode portion 223 is substantially uniform in the image forming region width F.

Using the charging blade 22 shown in FIG. 1, a durability evaluation has been carried out. For the evaluation, 6000 sheets are processed, and thereafter, the wearing amount of the drum 1 at the longitudinally end position 222*c* of the charge portion of the charging blade 22 is measured. In the case that the free end portion of the electrode portion 223 of the charging blade 22 is shorter than that of the charge portion 222 in the longitudinal direction, no image defect results, and drum scraping amount at the longitudinally end position 222*c* of the charge portion is 5.4 μm after 6000 prints.

Figure 7:
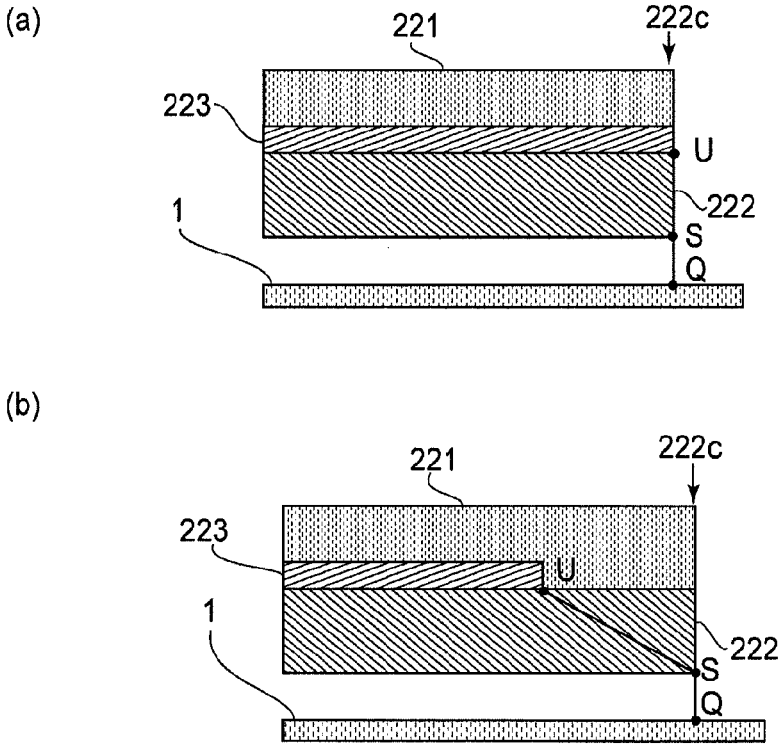
FIG. 7 is an illustration of concept of reduction of discharge amount at the longitudinal end portion of the charging blade.

FIG. 7 is an illustration of reduction of the discharge amount of the charging blade 22 used in this embodiment. In FIG. 7, part (b) is a schematic view of an electroconductive path in the neighborhood of the longitudinal end of the charge portion at (b) of FIG. 1. At the discharging position S in the longitudinal end of the charge portion 222, the bias voltage is supplied from the closest position U of the electrode portion 223 of a metal. Therefore, with the increase of the length of the line segment S-U, a volume resistivity in the electroconductive path of the charge portion 222 increases, and the discharge at the longitudinal end of the charge portion 222 decreases.

With the charging blade of this embodiment shown in FIG. 1 having the electroconductive path shown in part (b) of FIG. 7, the distance between the discharging position S on the charge portion 222 and the supply position U on the electrode portion 223 is longer than with the charging blade having the electrode portion 223 extending to the longitudinal end as shown in part (a) of FIG. 7. By this, the discharge at the longitudinal end of the charge portion decreases so that the drum scraping can be suppressed.

Figure 8:
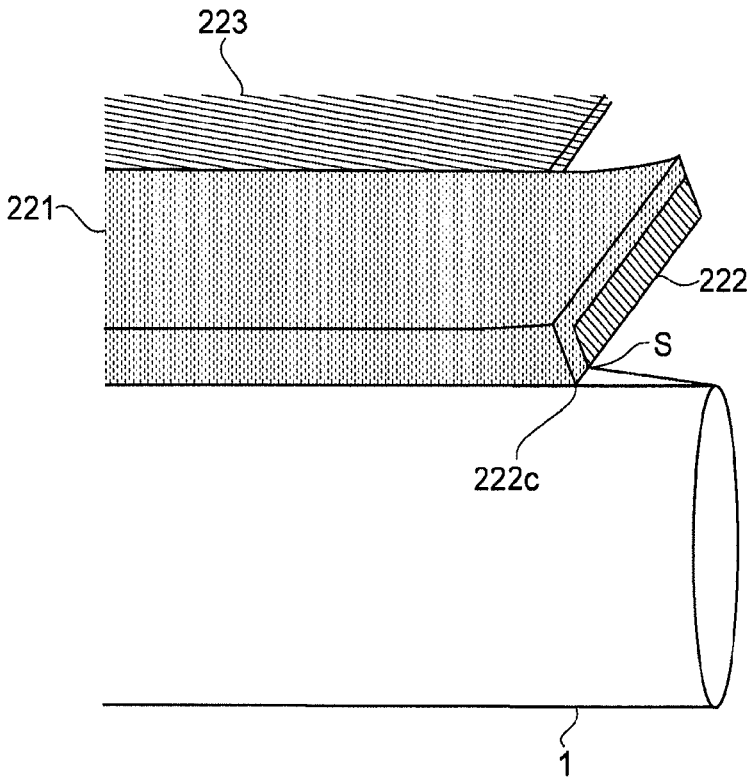
FIG. 8 is a schematic illustration of reduction of the contact pressure at the longitudinal end of the charging blade.

FIG. 8 is an illustration of the reduction of the contact pressure at the longitudinal end of the charging blade used in this embodiment. In the charging blade 22 of this embodiment, the electrode portion 223 is shorter than the charge portion 222 in the longitudinal direction. The electrode portion 223 is not at the longitudinal end of the charging portion 222 ((b) of FIG. 7) as compared with the electrode portion 223 which is at the longitudinal end of the charge portion 222 ((a) of FIG. 7). The contact pressure of the charging blade 22 to the drum 1 in the longitudinal end portion is lower than in the central portion where the electrode portion 223 exists.

As a result, in the image forming region width F, the distance S-U between the discharging position S of the charge portion 222 and the electrode portion 223 at the closest and the discharge gap SQ are substantially uniform along the length of the charging blade. Therefore, in the image forming region, the conventional uniform charging is accomplished without generation of the image defect, and in addition, in the longitudinal ends of the charge portion and the ends of the charging blade where the drum scraping is remarkable, the scraping amount of the drum 1 can be suppressed, and therefore, the service life can be expanded.

Figure 9:
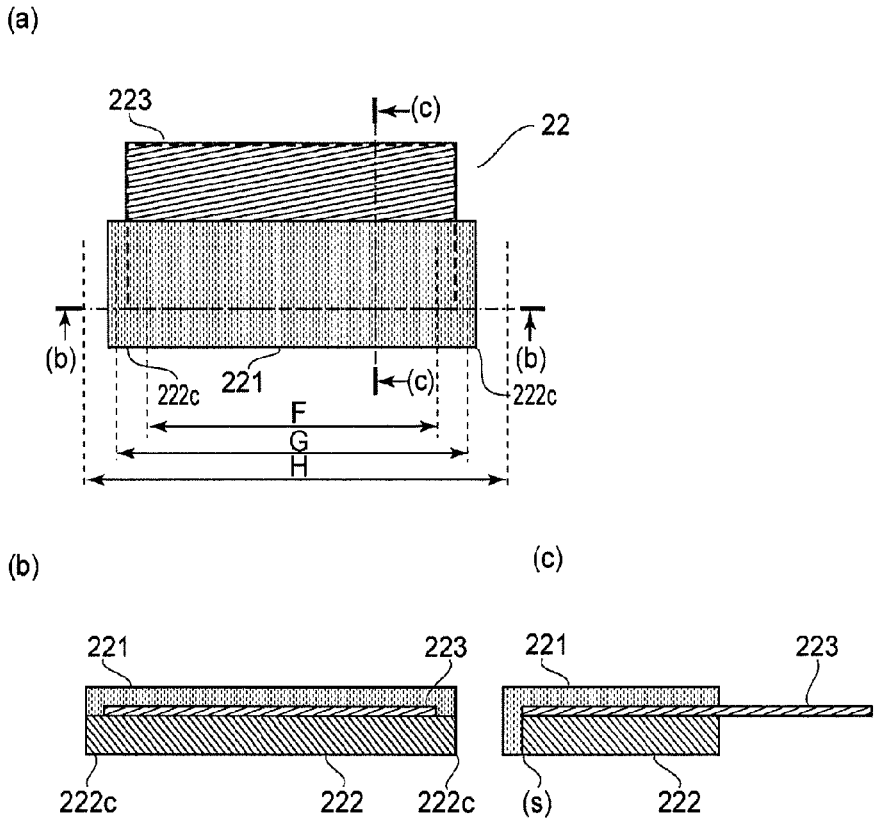
FIG. 9 is an illustration of another example of Embodiment 1.

In this Embodiment 1, the width of the charging blade 22 measured in the longitudinal direction is shorter than the maximum sheet processing width G. However, as shown in FIG. 9(*a*), the sheet processing width G may be inside the longitudinal ends of the charging blade 22. Also in such a case, the drum scraping of the drum 1 at the longitudinal ends of the charging blade 22 and the generation of the image defect attributable thereto are reduced.

In addition, as shown in FIG. 10 it is unnecessary that the charge portion 222 extends to the longitudinal ends of the charging blade 22. What is necessary is that the image forming region width F is inside the electrode portion 223 and the charge portion 222. And, if the distance S-U between the electrode portion 223 and the discharging position S of the charge portion 222 in the width F of the image forming region is shorter than the distance S-U at the longitudinal ends of the charge portion 222, the charging blade end 222*c* may be constituted by a insulative portion 221. By doing so, the similar advantageous effects can be provided.

Comparison Example 1

Figure 11:
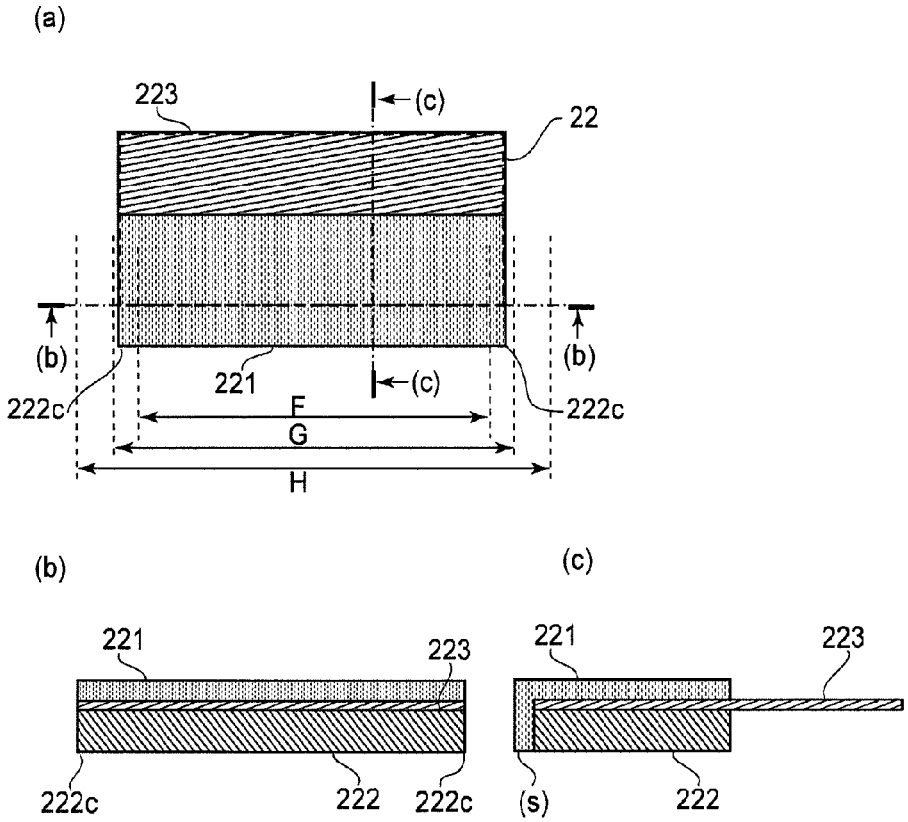
FIG. 11 is a schematic view of an according to a comparison example 1.

FIG. 11 shows a charging blade of a comparison example 1. In FIG. 11, part (a) is a schematic view as seen from a non-contact surface side relative to the drum 1, and the broken lines in the Figure depict edges of the electrode portion 223. In FIG. 11, part (b) and part (c) are sectional views as seen in a direction indicated by the arrow (b) in part (a), and as seen in a direction indicated by the arrow (c) in part (a), respectively. This example has the same structures as with Embodiment 1, except for the longitudinal dimension relation between the charge portion 222 and the electrode portion 223. In this charging blade 22 of comparison example 1, a longitudinal dimension of the electrode portion 223 is the same as the longitudinal dimension of the charge portion 222. The image forming region width F, the maximum sheet processing width G and the cleaning width H at this time is as shown in FIG. 11(*a*).

Tests were performed with the charging blade installed in the image forming apparatus. After processing 5000 sheets for printing, a black stripe was produced adjacent to an end of the recording material corresponding to the maximum sheet processing width G. At this time, the drum surface was scraped by 9.7 μm at the longitudinal end positions of the charge portion. This is considered as having been caused by the concentration discharge at the longitudinal ends of the charge portion and by the high contact pressure thereat.

Embodiment 2

In a charging blade 22 of this Embodiment 2, a longitudinal dimension of an electrode portion 223 reduces toward a free end thereof, and the longitudinal dimension of a non-charging portion minute of the electrode portion 223 is shorter than the longitudinal dimension of the charge portion 222. The closest distance between the discharging position S and the electrode portion 223 is substantially uniform in the image forming region width F.

Figure 12:
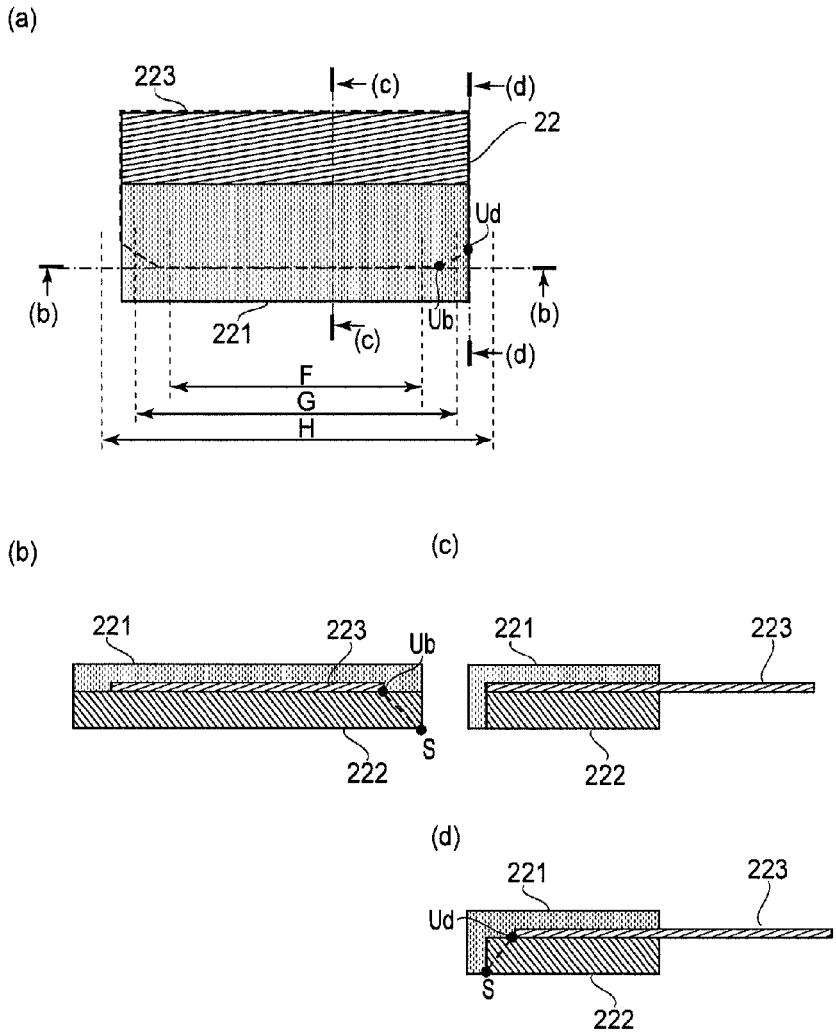
FIG. 12 is a schematic view of a charging blade in Embodiment 2.

FIG. 12 shows the charging blade 22 of this Embodiment 2. In FIG. 12, part (a) is a schematic view as seen from a non-contact surface side relative to the drum 1, and the broken lines in the Figure depict edges of the electrode portion 223. In FIG. 12, part (b), part (c) and part (d) are sectional views as seen in a direction indicated by the arrow (b) in part (a), as seen in a direction indicated by the arrow (c) in part (a), and as seen in a direction indicated by the arrow (d) in part (a), respectively. The electrode portion 223 becomes thinner toward the free end, and the longitudinal dimension of the charge portion 222 at the free end position of the electrode portion 223 is smaller than that of the electrode portion 223, and in the other respects, the structures are the same as with Embodiment 1. Thus, the longitudinal dimension of the electrode portion 223 becomes shorter toward the free end.

Using the charging blade, no image defect results, and a drum scraping amount at the longitudinally end position 222*c* of the charge portion is 6.8 μm after 6000 prints. In the foregoing description, the decrease of the discharge amount at the longitudinal ends of the charge portion 222 has been described referring to FIG. 6. In this embodiment, a line segment S-Ud in part (d) of FIG. 12 which is a sectional view as seen from a side surface of the charging blade is shorter than a line segment S-Ub in part (b) of FIG. 12 which is a sectional view in the longitudinal direction, and therefore, the closest point from the discharging position S is as indicated by Ud, and the shortest distance is at the line segment S-Ud.

Figure 13:
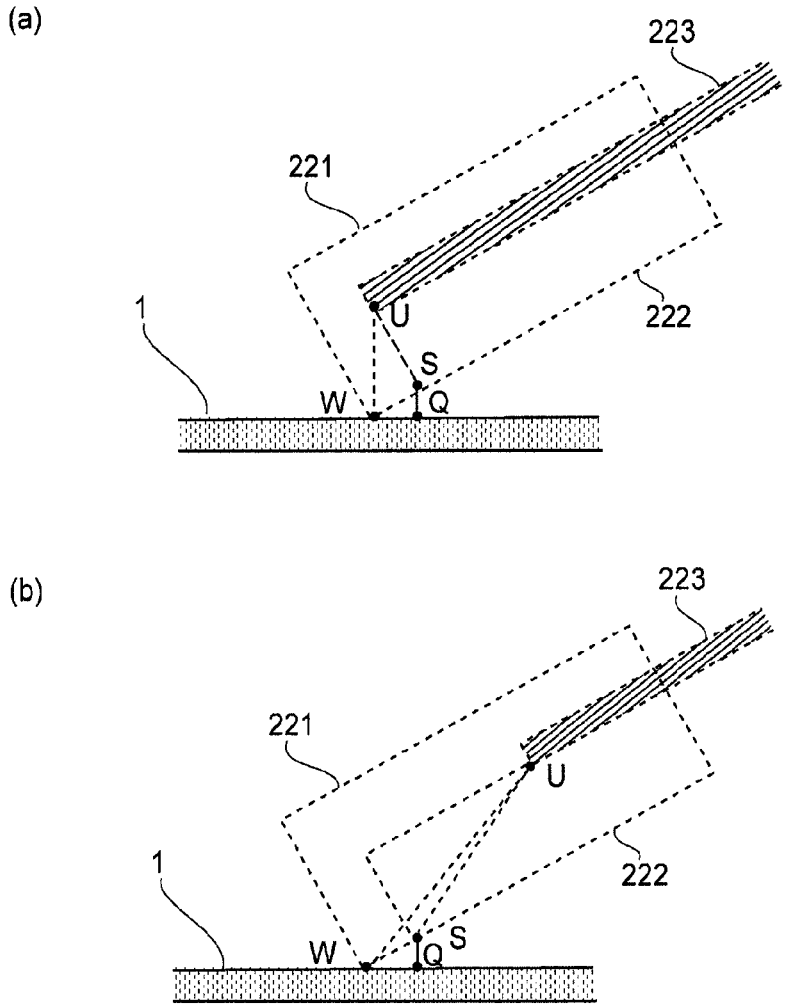
FIG. 13 is an illustration of concept of the reduction of the discharge amount at the longitudinal end of the charging blade charge portion.
Figure 14:
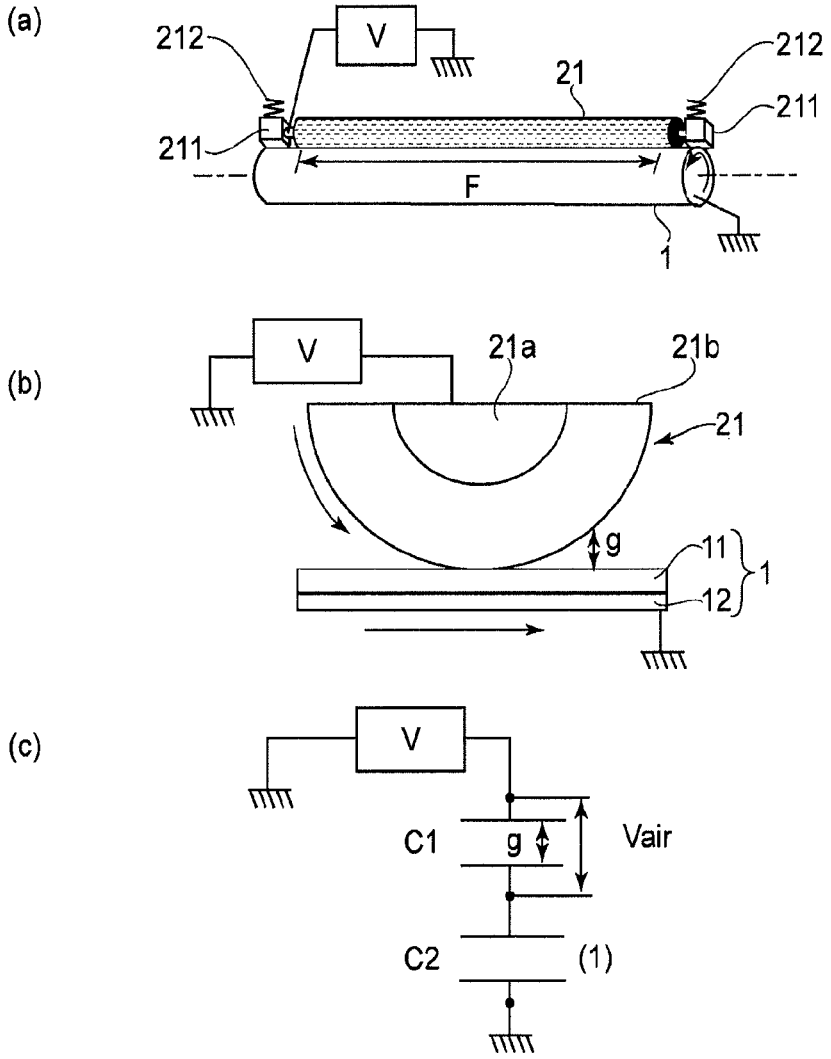
FIG. 14 is an illustration of a charging roller.
Figure 15:
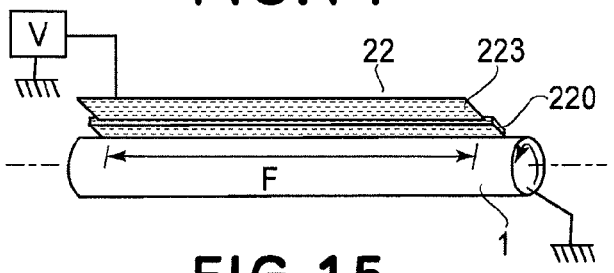
FIG. 15 is an illustration of a charging blade.

In Embodiment 1, the description has been made as to the electroconductive path in the longitudinal section using FIG. 6. But this is not inevitable. FIG. 13 schematically shows an electroconductive path in the section of the charging blade 22 as seen from the side surface, and as shown in this Figure, in this embodiment, the distance at the free end U between the electrode portion 223 and the discharging position S on the charge portion 222 when the image region is as shown in (a). As shown in part (b), in the longitudinal ends of the charge portion 222, at least, the length is made longer than SU, by which the discharge at the longitudinal ends of the charge portion 222 can be decreased similarly to the Embodiment 1.

Part (b) of FIG. 13 is a sectional view at the longitudinal end of the charge portion 222 of the charging blade 22 of Embodiment 2, wherein a length of the line segment UW which is a distance from the position U of the free end of the electrode portion 223 and a contact position W between the drum 1 and an insulative portion 222 is longer than that in part (a) which shows a longitudinal image region. By using the charging blade of Embodiment 2, a contact pressure at the longitudinal end positions of the charge portion 222 can be reduced. By this, the scraping of the drum 1 at the longitudinal end position of the charge portion can be reduced, and therefore, the service life of the drum 1 can be expanded.

[Others]

1) The image bearing member on which the electrostatic latent image is formed is not limited to the electrophotographic photosensitive member for an electrophotographic type apparatus of the embodiments. It may be a dielectric member for electrostatic recording for an electrostatic recording type apparatus. The image bearing member is not limited to the drum type. It may be an endless rotatable belt, a traveling non-endless belt or the like. The image bearing member may be a sheet-like member (electro-facsimile machine paper, electrostatic recording paper) fed by a feeding means.

2) The relative movement between the image bearing member and the charging member is not limited to the case in which the image bearing member moves relative to the fixed charging member as in the foregoing embodiments, but the charging member may move relative to the fixed image bearing member, or both of the charging member and the image bearing member move with relative movement therebetween.

3) The contact of the charging member relative to the image bearing member is not limited to the counterdirectional contact as in the foregoing embodiments, but the codirectional contact may be employed. In addition, the edge contact is not inevitable, but convex contact can be employed.

4) In the present invention, the charging of the surface of the image bearing member by the charging member is not limited to applying the electric charge thereto, but includes the case of electrically discharging the image bearing member, that is, removing the electric charge from the image bearing member.

5) In the foregoing embodiments, the charging blades 22 have been taken, but the present invention is not limited to the application to the charging blade, but may be a charging and cleaning blade contacted to a surface of the drum. In the case of the charging and cleaning blade, the free end portion of the blade contacts to the entire range of the drum cleaning width H.

INDUSTRIAL APPLICABILITY

According to the present invention, it is possible to provide a charging member in which the remarkable scraping of the image bearing member at the end portions of the charging member is suppressed. It is also possible to provide an image forming apparatus using such a charging member.

While the invention has been described with reference to the structures disclosed herein, it is not confined to the details set forth and this application is intended to cover such modifications or changes as may come within the purpose of the improvements or the scope of the following claims.

The invention claimed is:

1. A blade-like charging member for charging a surface of an image bearing member by contacting thereto and by being supplied with a voltage, said charging member comprising:

a charging portion for effecting electric discharge to the surface of the image bearing member;

a non-charging portion not effecting electric discharge to the surface of the image bearing member, said non-charging portion capable of contacting the image bearing member with maintaining an electrically dischargeable gap between said charging portion and the image bearing member; and an electrode portion, wherein at least a part of said non-charging portion is made of a material having a higher resistance than that of said charging portion so as to prevent electric discharge between said non-charging portion and the surface of the image bearing member, and said non-charging portion is contacted to and slidable on the surface of the image bearing member over a range not less than a longitudinal dimension of said charging portion, wherein said charging portion electrically discharges at a discharge position by being supplied with a voltage to said electrode portion, and wherein a shortest distance between an end portion the discharge position with respect to a longitudinal direction of said image bearing member and an end portion of said electrode portion with respect to the longitudinal direction of said image bearing member is longer than a shortest distance between the discharge position and a central portion of said electrode portion with respect to the longitudinal direction of said image bearing member.

2. A charging member according to claim 1, wherein a length of said electrode portion measured along the longitudinal direction of the image bearing member decreases toward a free end of said electrode portion.

3. A charging member according to claim 1, wherein a closest distance between said discharging position and said electrode portion is substantially uniform in an image forming region.

4. An image forming apparatus comprising said charging member according to claim 1, and a voltage source for applying a voltage to said charging member.

5. A charging member according to claim 1, wherein said electrode portion has a free end extending along the longitudinal direction of the image bearing member and having a length that is shorter than the length of said discharging portion measured along the longitudinal direction.

6. A charging member according to claim 5, wherein said free end is longer than a width of an image forming region on which an image is formed.

* * * * *